US009028583B2

(12) United States Patent
Myers et al.

(10) Patent No.: US 9,028,583 B2
(45) Date of Patent: May 12, 2015

(54) PROCESS FOR PRODUCING REFRACTORY METAL ALLOY POWDERS

(75) Inventors: James F. Myers, Palm City, FL (US); Scott Ohm, Coldwater, MI (US)

(73) Assignee: United Technologies Corporation, Hartford, CT (US)

( * ) Notice: Subject to any disclaimer, the term of this patent is extended or adjusted under 35 U.S.C. 154(b) by 352 days.

(21) Appl. No.: 13/570,415

(22) Filed: Aug. 9, 2012

(65) Prior Publication Data

US 2015/0082945 A1 Mar. 26, 2015

Related U.S. Application Data

(62) Division of application No. 12/342,254, filed on Dec. 23, 2008, now Pat. No. 8,268,035.

(51) Int. Cl.

| | |
|---|---|
| ***B22F 3/10*** | (2006.01) |
| ***B22F 9/04*** | (2006.01) |
| ***B22F 9/06*** | (2006.01) |
| ***C22C 1/02*** | (2006.01) |

(52) U.S. Cl.
CPC ... *B22F 9/04* (2013.01); *B22F 9/06* (2013.01); *C22C 1/02* (2013.01); *B22F 3/1017* (2013.01)

(58) Field of Classification Search
None
See application file for complete search history.

(56) References Cited

U.S. PATENT DOCUMENTS

| | | | | |
|---|---|---|---|---|
| 3,798,009 | A * | 3/1974 | Yamaya et al. | 75/241 |
| 3,881,911 | A * | 5/1975 | Cheney et al. | 75/255 |
| 3,909,241 | A | 9/1975 | Cheney et al. | |
| 4,025,334 | A * | 5/1977 | Cheney et al. | 75/236 |
| 4,088,480 | A | 5/1978 | Kim et al. | |
| 4,233,277 | A | 11/1980 | Sheppard | |
| 4,395,279 | A * | 7/1983 | Houck | 75/255 |
| 4,502,885 | A | 3/1985 | Cheney | |
| 4,716,019 | A * | 12/1987 | Houck et al. | 419/17 |
| 4,756,746 | A | 7/1988 | Kemp, Jr. et al. | |
| 4,783,218 | A | 11/1988 | Kemp, Jr. et al. | |
| 4,999,051 | A * | 3/1991 | Yolton et al. | 75/338 |
| 5,294,242 | A | 3/1994 | Zurecki et al. | |
| 5,340,377 | A | 8/1994 | Accary et al. | |
| 5,595,616 | A | 1/1997 | Berczik | |
| 5,693,156 | A | 12/1997 | Bercik | |
| 6,599,345 | B2 * | 7/2003 | Wang et al. | 75/231 |

(Continued)

FOREIGN PATENT DOCUMENTS

| | | |
|---|---|---|
| EP | 0028885 A1 | 5/1981 |
| EP | 0741193 A1 | 11/1996 |
| EP | 0806489 A2 | 11/1997 |

OTHER PUBLICATIONS

P.W. Lee, et al.; ASM Handbook, Dec. 1, 1998, XP002571581, vol. 7, pp. 92-96, ASM International, Materials Park, OH, US.

(Continued)

*Primary Examiner* — George Wyszomierski

(74) *Attorney, Agent, or Firm* — Bachman & LaPointe, P.C.

(57) ABSTRACT

A process for producing refractory metal alloy powders includes the steps of blending at least one powder with at least one solvent and at least one binder to form a slurry; forming a plurality of agglomerates from the slurry; screening the plurality of agglomerates; sintering the plurality of agglomerates; and melting said plurality of agglomerates to form a plurality of homogenous, densified powder particles.

8 Claims, 5 Drawing Sheets

(56) References Cited

U.S. PATENT DOCUMENTS

| | | | |
|---|---|---|---|
| 6,652,674 | B1 | 11/2003 | Woodard et al. |
| 6,786,950 | B2 | 9/2004 | Yadav et al. |
| 7,399,335 | B2 | 7/2008 | Shekhter et al. |
| 7,551,242 | B2 | 6/2009 | Aoyama |
| 2002/0050185 | A1 | 5/2002 | Oda |

OTHER PUBLICATIONS

Z. Li, L.M. Peng, Ultra-high Temperature Mo-Si-B alloys—Synthesis, Microstructural and mechanical characterization, Materials Letters, vol. 62, (2008—online Nov. 28, 2007), pp. 2229-2232.

* cited by examiner

PROCESS FOR PRODUCING REFRACTORY METAL ALLOY POWDERS

CROSS REFERENCE TO RELATED APPLICATION(S)

The instant application is a divisional patent application of U.S. Pat. No. 8,268,035, filed Dec. 23, 2008, entitled PROCESS FOR PRODUCING REFRACTORY METAL ALLOY POWDERS.

GOVERNMENT RIGHTS

The United States Government may have certain rights in the invention pursuant to contract number F33615-98-C-2874 awarded by the United States Air Force.

FIELD OF THE INVENTION

The invention relates to refractory metal alloy powders and, more particularly, relates to process(es) for producing refractory metal alloy powders.

BACKGROUND OF THE INVENTION

Advanced gas turbine engines require alloys exhibiting very high melting points in order to increase performance and operating efficiency. Molybdenum-based alloys have been developed to increase the turbine operating temperature as disclosed in U.S. Pat. No. 5,693,156 to Berczik, U.S. Pat. No. 5,595,616 to Berczik, and U.S. Pat. No. 6,652,674 to Woodard et al., which are all incorporated herein by reference in their entireties. The molybdenum-based refractory metal alloys described therein are attractive candidates to replace nickel-based alloys due to their higher melting point temperatures (approximately 4000° F. to 5000° F.), high coefficients of thermal conductivity (approximately 690 BTU-in/hr $ft^2$-° F.), low coefficients of thermal expansion (approximately $3.5\times10^{-6}$/° F.), and high modulus. In part, these characteristics are due to these alloys containing constituents with widely varying melting points.

However, the characteristic high temperature capabilities of the aforementioned molybdenum-based alloys also present an obstacle during the production and processing of the alloys. Due to the high melting points and high thermal conductivity coefficients, the molybdenum-based alloys prove to be extremely difficult to melt and cast using traditional processes. Additionally, the mechanical properties of the alloys are highly dependent upon a fine microstructure that cannot be obtained through traditional casting or powder metallurgical processes. As disclosed in U.S. Pat. No. 5,595,616, it was discovered that complete melting and rapid solidification of the melt is necessary to produce the ideal microstructure and subsequent mechanical properties exhibited by these molybdenum-based alloys.

In the past, a widely-recognized process for producing powders of these aforementioned molybdenum-based alloys was rotary atomization as disclosed in U.S. Pat. No. 5,595,616. While rotary atomization was capable of producing usable materials, the process demonstrated limited efficiency. The low efficiency of rotary atomization and the inability of other powder production techniques to produce an ideal powder are directly related to the difficulties present in fully melting the aforementioned molybdenum-based alloy and allowing a homogeneous, fully alloyed liquid to form which could then be rapidly solidified.

Therefore, there is a need for a powder production process capable of efficiently producing powder with the ideal microstructure.

SUMMARY OF THE INVENTION

In accordance with one aspect of the present disclosure, a process for producing refractory metal alloy powders broadly comprises blending at least one powder with at least one solvent and at least one binder to form a slurry; forming a plurality of agglomerates from the slurry; screening the plurality of agglomerates; sintering the plurality of agglomerates; and melting the plurality of agglomerates to form a plurality of homogenous, densified powder particles.

In accordance with another aspect of the present disclosure, a molybdenum-based refractory metal alloy made according to a process broadly comprising the steps of blending at least one powder with at least one solvent and at least one binder to form a slurry; forming a plurality of agglomerates from the slurry; screening the plurality of agglomerates; sintering the plurality of agglomerates; and melting the plurality of agglomerates to form a plurality of homogenous, densified powder particles.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

The process disclosed herein may be employed to manufacture a powder form of any one of several refractory metal alloys known to one of ordinary skill in the art. For example, such refractory metal alloys that may be manufactured in a powder form may include the oxidation resistant molybdenum alloys disclosed in U.S. Pat. No. 5,693,156 to Berczik et al. and U.S. Pat. No. 5,595,616 to Berczik et al., and an oxidation resistant molybdenum alloy disclosed in U.S. Pat. No. 6,652,674 to Woodard et al. Additional refractory metal alloys that may be manufactured in a powder form may include, but are not limited to Nb, Ta and W.

Figure 1:
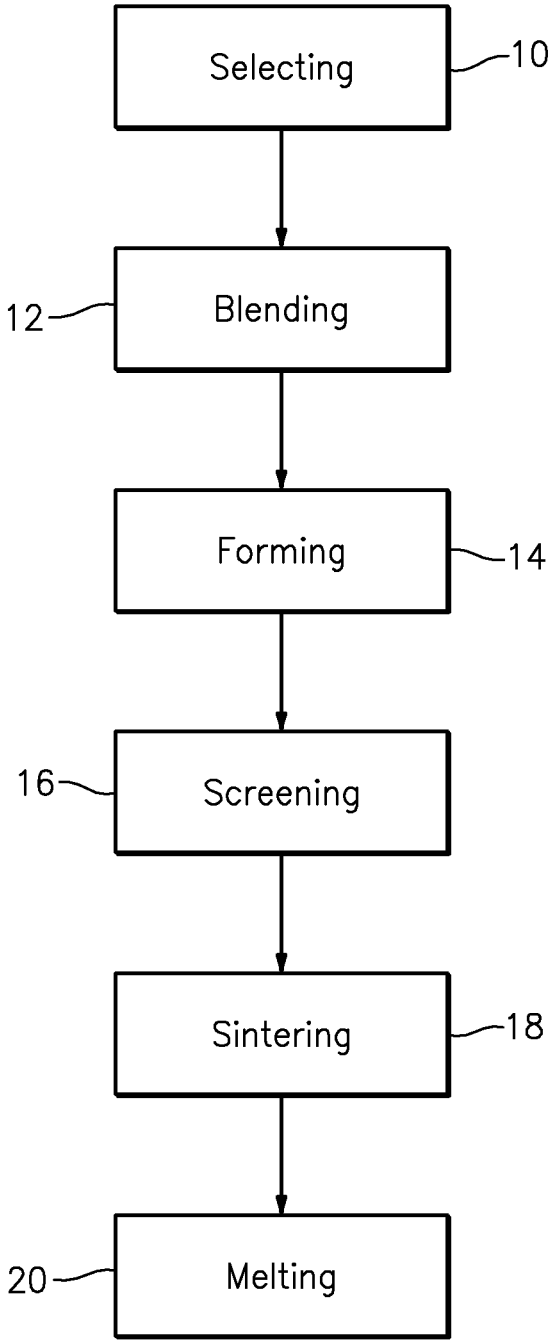
FIG. 1 is a representative flowchart illustrating the steps of at least one exemplary process of the present invention.

Referring to FIG. 1, the exemplary process begins by selecting a starting powder or powders at step 10. The starting powders may be in the form of an elemental or multi-component compound powder. For example, when the desired end product contains molybdenum, silicon, and boron, a multi-component compound powder such as molybdenum disilicide may be utilized to supply the silicon and molybdenum. This is advantageous over a combination of elemental silicon and elemental molybdenum. Multi-component compound powders are preferred as their use ultimately reduces losses, and promotes efficiency and product yield, due to oxidation and volatilization of the lower melting point silicon. For example, representative multi-component compound powders for use herein may include $MoB_2$, $MoSi_2$, $SiB_x$ where x=3-6, and $MoSi_yB_z$, where y=1-6 and z=1-6.

The starting powder(s) may be sufficiently fine to allow for the desired alloy content in each of the resulting individual agglomerates. Suitable starting powder(s) may have a particle size distribution ranging from at least about 0.1 μm to at least about 10 μm. Suitable starting powders should be selected to minimize any deleterious chemical contaminants that are not desired in the final alloy composition. The oxygen content of the final alloy composition may be controlled and possess a range of at least about 0.01 weight % to no more than about 1.5 weight % of oxygen. The carbon content of the final alloy composition may be controlled and possess a range of at least about 0.05 weight % to no more than about 0.5 weight % of carbon.

Once selected, the starting powders may then be blended at step 12 of FIG. 1. The blending step may include milling to change the particle size distribution of the starting powders to achieve a more desirable range. The starting powders may be blended using an appropriate combination of elemental powders and multi-component compound powders to achieve the desired final alloy composition, or a combination of such powders, water or other suitable solvent, and a binder.

The binder selection may be predicated upon the compatibility of all the starting powders and selected binder, and the need for the powder agglomerates to hold their spherical shape during the plasma densification process that follows. Through experimentation, suitable binders have been identified as being a mixture of ammonium molybdate and polyvinyl alcohol; polyvinyl alcohol alone; a nonionic water soluble cellulose ether, such as hydroxypropylcellulose, commercially available as Klucel® from Aqualon a subsidiary of Hercules Inc., Wilmington, Del., and combinations comprising at least one of the foregoing, and the like. These binders strengthen the powder agglomerates and burn off easily without causing the agglomerate particles to fracture during decomposition and while also leaving little carbon residue in the final powder.

After blending the starting powders with water or a suitable solvent and binder material(s) to form a slurry, the slurry may be spray dried to form a plurality of agglomerates using any one of a number of techniques known to one of ordinary skill in the art at step 14. For example, suitable spray drying processes may include rotary atomization, nozzle atomization, and the like. The spray drying process may be optimized to produce agglomerate sizes that are amenable to being fully melted. Generally, the agglomerates may exhibit a binder concentration of about 0.1% to about 1% by weight of agglomerate, an oxygen content of about 0.1% to about 2.5% by weight of agglomerate, and a carbon content of about 0.05% to about 0.5% by weight of agglomerate. The resulting as-spray dried agglomerates may then be screened at step 16 to carefully select agglomerates having optimal particle size distribution commensurate with the starting powder particle size(s) and to ensure complete melting will be achieved. Any one of a number of screening processes, e.g., manual and automated, may be utilized as known to one of ordinary skill in the art.

Once screened, the as-spray dried agglomerates may be sintered at step 18 of FIG. 1 to increase their strength and drive off the binder. The as-spray dried agglomerates may be sintered under a dry hydrogen or other appropriate atmosphere at a temperature of at least about 1,800° F. (980° C.) for at least about 0.5 hours. The use of a dry hydrogen atmosphere during sintering prevents oxidation of any silicon or silicon-containing phases and the subsequent volatilization and loss of such oxides. Though experimentation, other appropriate atmospheres include vacuum, partial vacuum, and inert gas. The resulting individual sintered agglomerates may then be composed of non-equilibrium phases in the correct ratio with respect to the overall chemistry of the powder to yield the correct alloy composition.

Figure 2:
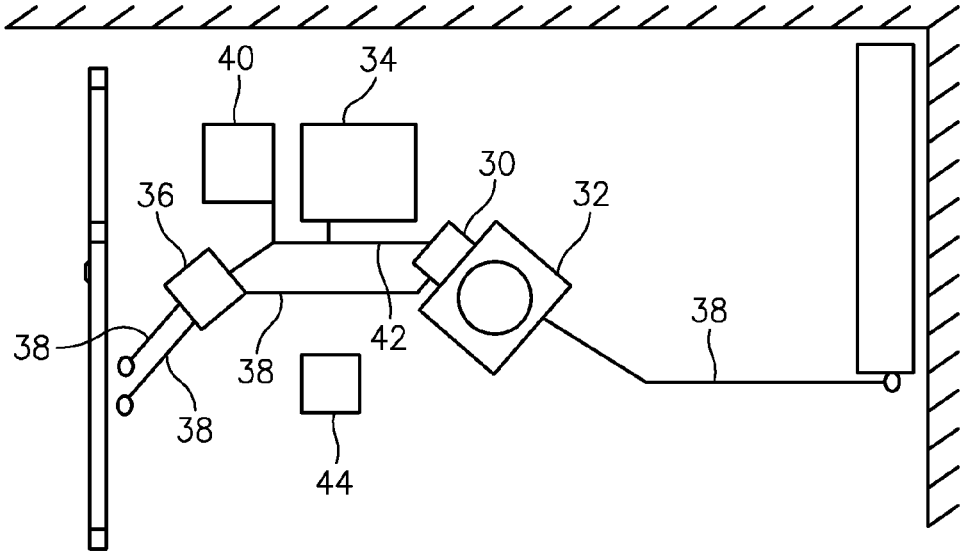
FIG. 2 is a representation of an exemplary plasma densification system for use with the exemplary process(es) described herein.

Referring now to FIGS. 1 and 2, the sintered agglomerates may then be fed through a heat source to individually melt each agglomerate at step 20 of the Figure. The agglomerates may be melted using a plasma densification system composed of a plasma gun 30 mounted within a water cooled chamber 32. A water chiller 34 may be disposed in connection with the chamber 32. The chamber 32 may be fed a quantity of sintered agglomerates by a powder feeder 36 via compressed gas supplied by at least one supply gas line 38. The gas supply may be composed of a mixture of argon, nitrogen, helium and hydrogen. The entire system may be powered using a power supply unit 40 via at least one power connection line 42. The resulting plasma densified agglomerate particles may be collected in an inert atmosphere within the water cooled chamber 32. The entire process may be monitored using a control station 44 as known to one of ordinary skill in the art.

In order to ensure the sintered agglomerates melt completely, the sintered agglomerates may be fed into the plasma flame at a location below the anode, rather than fed into the anode, and at a gas feed rate to ensure the sintered agglomerates spend a suitable amount of time within the plasma flame as known to one of ordinary skill in the art. In addition, the type of nozzle may also ensure the agglomerates melt completely as known to one of ordinary skill in the art. In addition, other suitable heat sources may include drop-tube furnaces where the agglomerates melt during free fall through a hot zone of the furnace and solidify after passing through the hot zone. The sintered agglomerates may be in-situ melted and alloyed in the plasma flame or heat source. During the plasma densification process, the agglomerates may become a homogeneous liquid of the desired alloy composition. The liquid agglomerates rapidly solidify as the agglomerates exit the plasma flame or heat source, forming homogeneous, fully dense, fully alloyed powder particles with a rapidly solidified microstructure.

EXPERIMENTAL SECTION

Example 1

Figure 3:
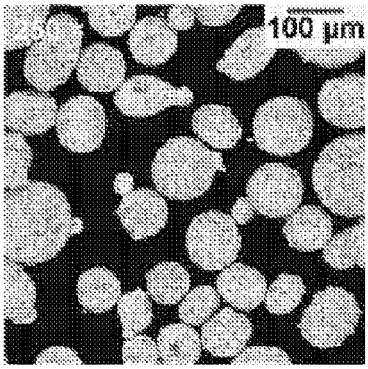
FIG. 3 is an SEI-SEM microphotograph of as-spray dried powder from Lot MSB007 of Example 1.
Figure 4:
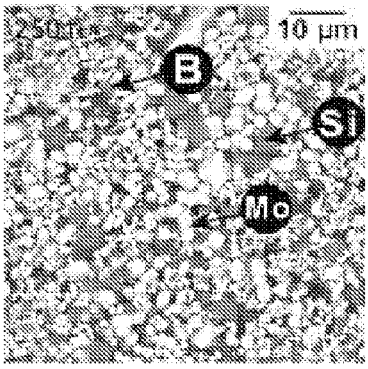
FIG. 4 is a high magnification microphotograph of as-spray dried powder of Example 1 showing individual constituents (Mo, Si, B) contained within the agglomerates.
Figure 5:
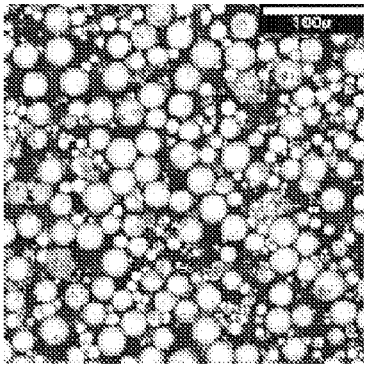
FIG. 5 is an SEI-SEM microphotograph of plasma densified powder of Example 1 prior to screening.
Figure 6:
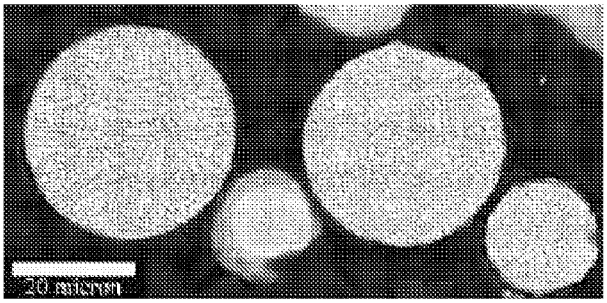
FIG. 6 is an SEI-SEM microphotograph showing a cross-section of plasma densified powder of Example 1 showing ideal microstructure and full density.

A multi-component compound powder Mo-2.6Si-1.4B wt % (Lot ID: MSB007; See Table 1 below) made from Mo, Si and B powders was blended and mixed with a polyvinyl alcohol binder to form a slurry. The slurry was spray dried to form as-sprayed agglomerates (See microphotographs of FIGS. 3 and 4). The as-sprayed agglomerates were then screened and sintered at 2,100° F. for 1 hour. The sintered agglomerates were then melted via plasma densification using a Baystate PG-120 plasma gun (See microphotograph of FIG. 5), and screened again. The resultant alloyed powder particles exhibited the particle size densities shown in Table 2 below (See microphotograph of FIG. 6).

TABLE 1

| LOT | BULK g/cu. in. | FLOW s/50 g | C wt % | $O_2$ wt % | B wt % | Si wt % |
|---|---|---|---|---|---|---|
| MSB007 | 79.7 | 16 | 0.185 | 0.182 | 1.41 | 2.59 |

TABLE 2

| LOT | PSD, d10 | Microtrac, d50 | μ d90 |
|---|---|---|---|
| MSB007 | 27.5 | 41.0 | 59.5 |

Example 2

Figure 7:
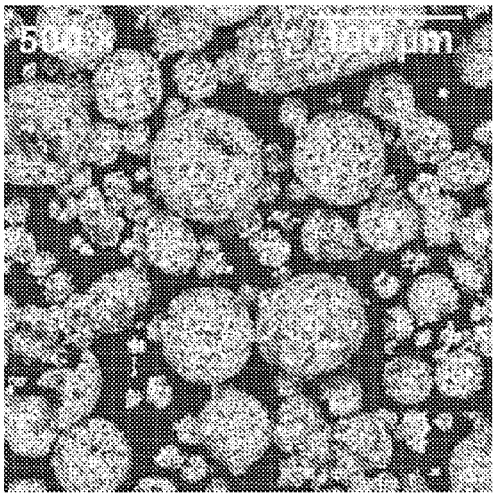
FIG. 7 is an SEI-SEM microphotograph of an as-spray dried powder from Lot MSB014 of Example 2.
Figure 8:
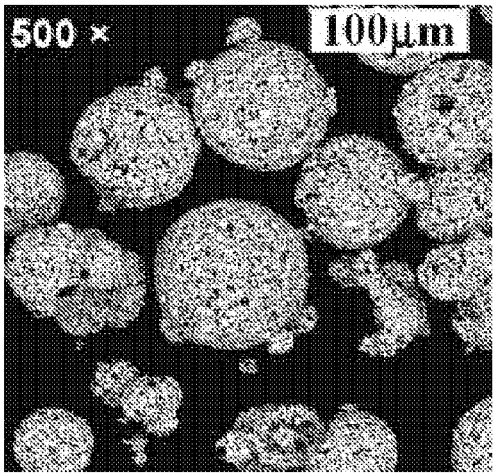
FIG. 8 is an SEI-SEM microphotograph of a spray dried and sintered powder of Example 2.
Figure 9:
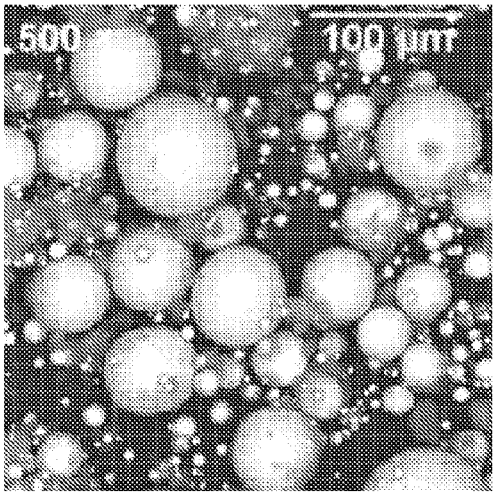
FIG. 9 is an SEI-SEM microphotograph of a plasma densified powder of Example 2 prior to screening.
Figures 10A, 10B:
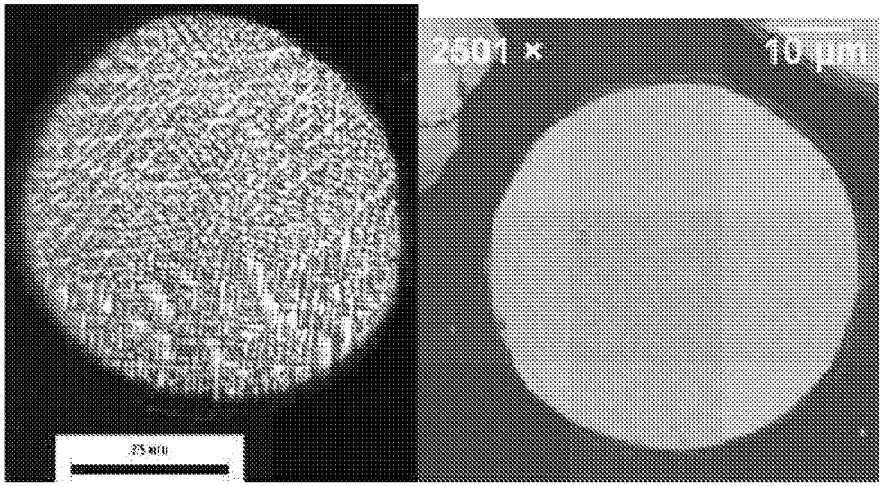
FIGS. 10A and 10B are microphotographs at different magnifications showing a cross-section of a plasma densified powder of Example 2 exhibiting ideal microstructure and full density.

A multi-component compound powder Mo-2.6Si-1.4B-0.3Fe wt % (Lot ID: MSB014; See Table 3 below) made from Mo, Si, $MoSi_2$, B and Fe powders was blended and mixed with a Klucel® binder to form a slurry. The slurry was spray dried to form as-sprayed agglomerates (See microphotographs of FIG. 7). The as-sprayed agglomerates were then screened and sintered at 2,750° F. for 1 hour (See microphotograph of FIG. 8). The sintered agglomerates were then screened with a −100/+325 mesh prior to undergoing plasma densification. The screened, sintered agglomerates were then melted via plasma densification (See microphotograph of FIG. 9) using a Progressive 100HE plasma gun with perpendicular side feed and two (2) powder ports, and screened again. The resultant alloyed powder particles exhibited the particle size densities shown in Table 4 below (See microphotographs of FIGS. 10A and 10B).

TABLE 3

| LOT | BULK g/cu. in. | FLOW s/50 g | C wt % | $O_2$ wt % | B wt % | Si wt % |
|---|---|---|---|---|---|---|
| MSB014 | 71.9 | 22 | 0.022 | 0.32 | 1.36 | 2.57 |

TABLE 4

| LOT | PSD, d10 | Microtrac, d50 | μ d90 |
|---|---|---|---|
| MSB014 | 11.4 | 45.7 | 72.4 |

The exemplary process described herein illustrates a process for producing homogeneous, fully-melted, fully-alloyed and rapidly solidified refractory metal powders. The process is capable of producing powder from metal alloys containing constituents with a wide-range of melting points. The process is capable of producing molybdenum alloy powders with the desired microstructure described herein. Furthermore, the process is capable of producing low oxygen content powders of alloys containing silicon.

One or more embodiments of the present invention have been described. Nevertheless, it will be understood that various modifications may be made without departing from the spirit and scope of the invention. Accordingly, other embodiments are within the scope of the following claims.

What is claimed is:

1. A process for producing refractory metal alloy powders, comprising:

blending at least one powder with at least one solvent and at least one binder to form a slurry;

forming a plurality of agglomerates from said slurry;

screening said plurality of agglomerates;

sintering said plurality of agglomerates;

melting said plurality of agglomerates to form a plurality of homogenous, densified powder particles;

sintering said plurality of homogeneous, densified powder particles; and melting said plurality of sintered, homogeneous, densified powder particles to form a plurality of twice sintered homogenous, densified powder particles.

2. The process of claim 1, wherein blending comprises blending said powder with at least one solvent and at least one binder comprising any one of the following: polyvinyl alcohol, cellulose adhesives, cellulose polymers, and combinations thereof.

3. The process of claim 1, wherein forming comprises spray drying said slurry to form said plurality of agglomerates using rotary atomization process or nozzle atomization process.

4. The process of claim 1, wherein screening comprises screening using a cyclone separator.

5. The process of claim 1, wherein sintering comprises heating said plurality of agglomerates under a dry hydrogen atmosphere at a temperature of at least about 1800° F. for at least about 0.5 hours.

6. The process of claim 1, wherein sintering comprises heating said plurality of agglomerates under an inert atmosphere at a temperature of at least about 1800° F. for at least about 0.5 hours.

7. The process of claim 1, wherein melting comprises melting individually each of said plurality of agglomerates using a heat source.

8. The process of claim 7, wherein said heat source comprises a plasma densification apparatus or a drop-tube furnace apparatus.

* * * * *